United States Patent [19]

Frielinghaus

[11] Patent Number: 4,570,882

[45] Date of Patent: Feb. 18, 1986

[54] VITAL TRACK CIRCUIT WHEEL DETECTOR

[75] Inventor: Klaus H. Frielinghaus, Rochester, N.Y.

[73] Assignee: General Signal Corporation, Stamford, Conn.

[21] Appl. No.: 458,234

[22] Filed: Jan. 17, 1983

[51] Int. Cl.[4] ..... B61L 21/00; B61L 3/34

[52] U.S. Cl. ..... 246/34 R; 246/122 R; 246/247

[58] Field of Search ..... 246/34 R, 41, 45, 122 R, 246/122 A, 124, 167 R, 249, 247; 340/21

[56] References Cited

U.S. PATENT DOCUMENTS

| | | | |
|---|---|---|---|
| 2,537,298 | 1/1951 | Baughman | 246/34 R |
| 2,993,116 | 7/1961 | Utt | 246/34 R |
| 3,353,018 | 11/1967 | Gray | 246/34 R |
| 3,740,549 | 6/1973 | Thorne-Booth | 246/122 R |
| 3,979,092 | 9/1976 | Perry | 246/34 R |
| 3,984,073 | 10/1976 | Woods | 246/34 R |
| 4,351,504 | 9/1982 | Frielinghaus | 246/122 R |
| 4,373,691 | 2/1983 | Fricke | 246/34 R |
| 4,392,626 | 7/1983 | Pascoe | 246/34 R |
| 4,469,298 | 9/1984 | Uebel | 246/122 R |

*Primary Examiner*—John W. Caldwell, Sr.
*Assistant Examiner*—Michael F. Heim
*Attorney, Agent, or Firm*—Ronald Reichman; Milton E. Kleinman; John F. Ohlandt

[57] ABSTRACT

A vital, or fail-safe, track circuit wheel detector for detecting the presence and position in a given detection zone of wheel-axles on railroad cars; in order to provide the requisite fail-safe indication, the operation of the system relies on a sensing means which produces two distinct output signals. The sensing means includes a biasing arrangement for providing, even in the absence of wheel-axles, a steady output signal derived from the path of normal feed current flow. This bias signal is countered or opposed by a wheel sensing signal from the same sensing means responsive to flux level changes resulting from the presence of particular directional components of wheel-axle shunt current, whereby a dip or net reduced signal is effectuated; in the case of open circuit conditions, the output indication goes to zero when there are no wheel-axles in the detection zone.

14 Claims, 19 Drawing Figures

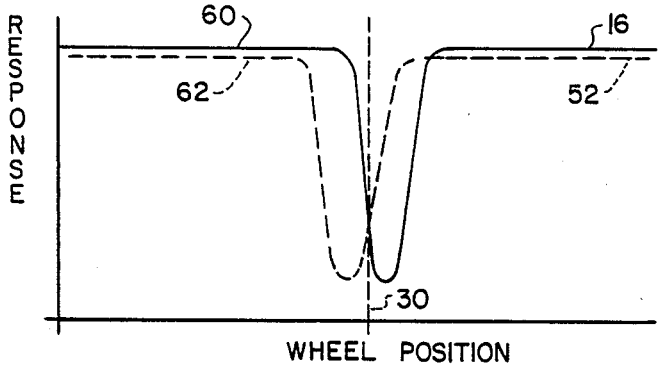
FIG.3
FIG.4
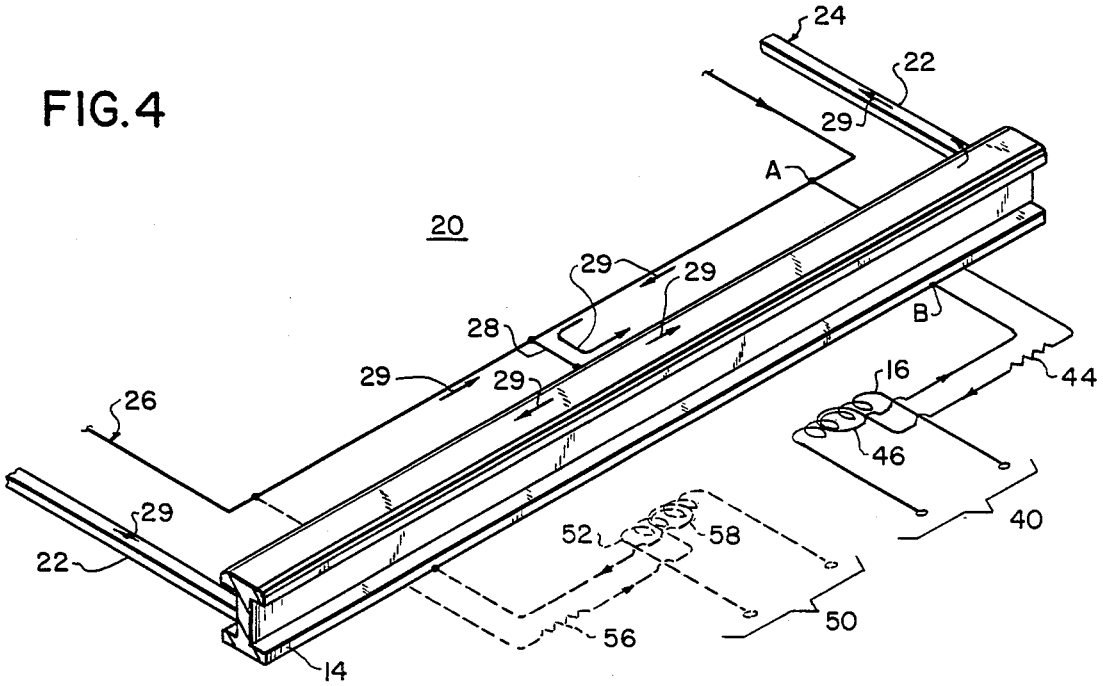

FIG.5
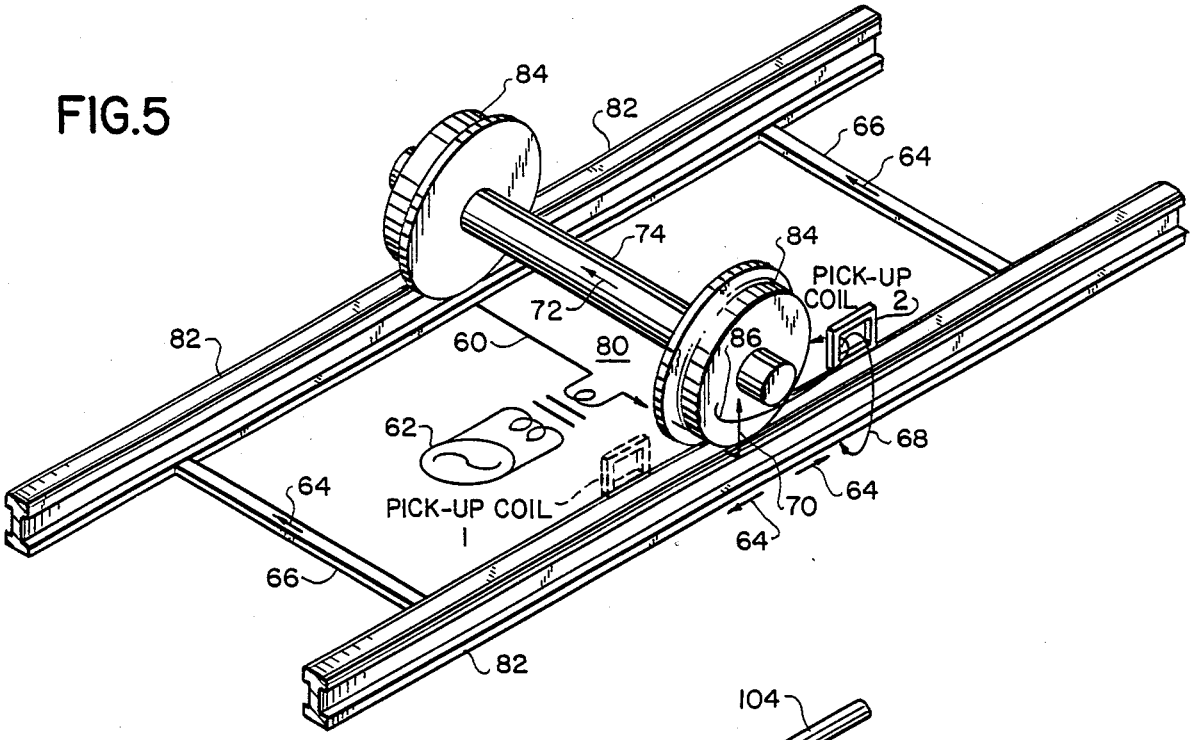
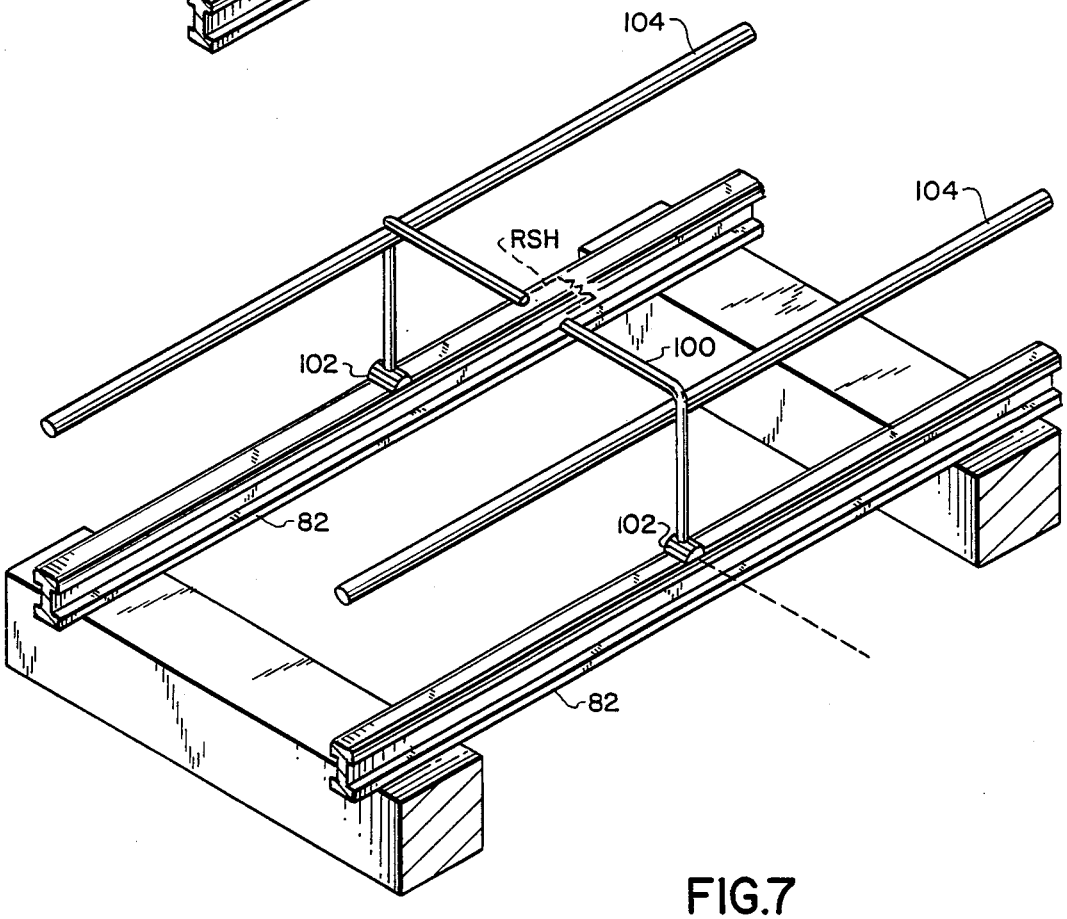
FIG.7

VITAL TRACK CIRCUIT WHEEL DETECTOR

BACKGROUND OBJECTS AND SUMMARY OF THE INVENTION

The present invention pertains to detection apparatus and more particularly, to apparatus for detecting, on a vital or fail-safe basis, the presence and position of individual wheel-axles of railroad cars, in a detection zone.

As background material for an understanding of the apparatus and technique of the present invention, reference may be made to the following patents: British Pat. No. 767,724; U.S. Pat. No. 3,697,455; U.S. Pat. No. 4,058,279 and U.S. Pat. 4,351,504; the last two mentioned patents being assigned to the assignee of the present invention. In accordance with the last-cited patent, there is described apparatus for sensing the presence of a car wheel by sensing a shunt current flowing through the car wheel-axle set. However, that system depends upon the presence of the car wheel in a detection zone or region to develop a suitable output voltage. In other words, in the event that a car wheel is not present, no substantial output signal is available to be sensed, an identical result to what certain failures in the system will produce.

The system of the present invention represents an improvement on the detection system of U.S. Pat. No. 4,351,504. In particular, instead of a standard track circuit wheel detector system, which is not capable of producing so called vital or fail-safe indications, the present improvement is concerned with enabling a vital, or fail-safe basis of operation. By vital or fail-safe operation is meant an operation which provides the most restrictive kind of output. For example, in the detection system under consideration, it is desired that in the event that there are open circuits or other failures present, a signal will be given that identifies such conditions, and represents such conditions as analogous to the presence of wheel-axles in the detection zone.

Accordingly, it is a primary object of the present invention to provide a vital, directional, wheel detection system that will permit detection of the presence and position of wheel-axles in a detection zone or section.

In fulfillment of the above-noted object, a primary feature of the present invention resides in a system for detecting the presence and position of railroad car wheel-axles in which a transmitter having a high frequency output is connected to a pair of rails which, together with suitable shorting means, constitute a path for the flow of high frequency current from said transmitter. A sensing means, including a pick-up coil, is provided to give a relatively sharp or abrupt indication when a wheel or wheel-axle combination is present in a detection zone. The sensing means also includes a biasing arrangement which provides a steady flow of bias current. When the "wheel-axle presence and position" output signal is generated, it acts to counter or oppose the bias current normally present. Thus an abrupt, negative-going output signal is detected responsive to the presence of the wheel-axles. However, if there are open circuit conditions present, a restricted output will be provided i.e. an output comparable to the presence of wheel-axles in the detection zone.

Another feature of the present invention resides in the particular arrangement for producing bias current. This can take the form of a coil means for feeding a small amount of bias current from the feed loop to a pick-up coil, or alternatively, it can take the form of a self-biasing arrangement whereby the pick-up coil itself develops a bias current by sensing the feed current present in one of the rails or the feed wire of the system. Other alternative schemes or arrangements and modifications thereof will be described.

Another feature relates to the way in which the output signal responsive to the presence of a wheel-axle is caused to develop. In one embodiment, this output signal is developed in response to all of the components of current flowing up through the wheel axle; that is, the vertical component of current through the radius of the wheel and the horizontal component through the axle itself. In another embodiment, which features a different arrangement for feeding the high frequency current to the rails, the pickup coil of the sensing means not only has currents induced in it from the rail, but is further effected by the current through the radius of the wheel only. However, it is not affected by current through the axle, nor current flowing in the feed wire or the shunt strap. In this embodiment the pick-up coil is located somewhere on a 45° angle plane bisecting the angle between the rail and the vertical wheel radius, assuming a location near to the center of the detecti zone.

Other and further objects, advantages and features of the present invention will be understood by reference to the following specification in conjunction with the annexed drawing, wherein like parts have been given like numbers.

BRIEF DESCRIPTION OF THE DRAWING

FIG. 3 is a graph of the response versus wheel position for the detection scheme of FIG. 2.

FIG. 4 illustrates a variation or modification from the embodiment of FIG. 2 involving a direct connection to the feed loop and rail loop.

FIG. 5 is a perspective schematic diagram illustrating a second embodiment of a detector system of the present invention.

FIG. 7 illustrates a test track simulation for testing the detector system of FIG. 5.

DESCRIPTION OF PREFERRED EMBODIMENTS

Figure 1:
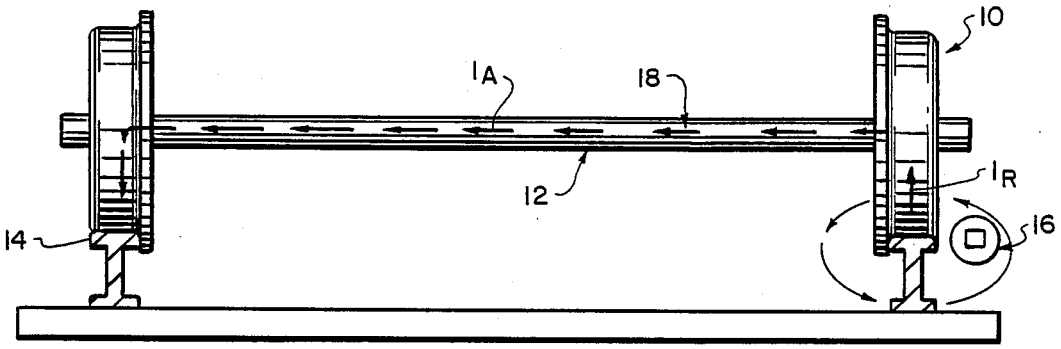
FIG. 1 is a diagrammatic showing of a typical wheel axle in contact with a pair of rails, and particularly illustrating the flow of wheel-axle shunt current and the vertical and horizontal components thereof.
Figure 2:
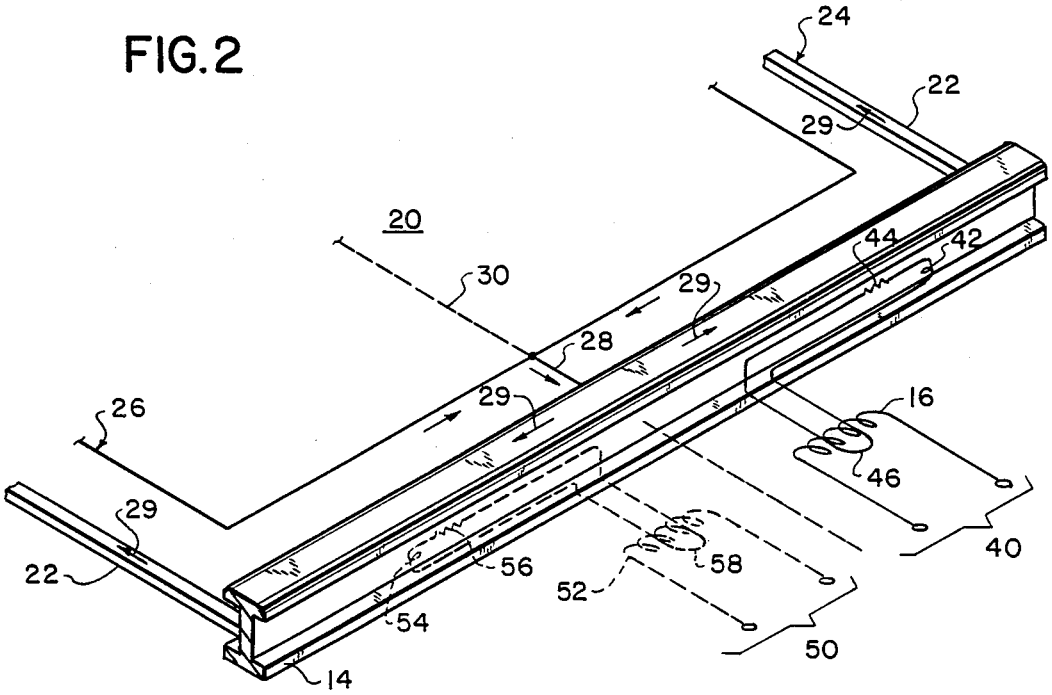
FIG. 2 is a perspective schematic diagram illustrating a first embodiment of the vital wheel detector system of the present invention.

Referring now to FIGS. 1–3, the vital detection system in accordance with the first embodiment is illustrated for detecting the presence and position of wheel-axles in a test or detection zone. In FIG. 1 a pair of wheels 10 mounted on an axle 12, as typically found on a railroad car or the like, is shown with respect to a pair of rails 14 located on the railroad bed. A pick-up coil 16 is located adjacent one of the rails 14, this pick-up coil being part of the sensing means previously referred to. For convenience the rail illustrated may be referred to as the south rail, it being understood that another rail is denominated the north rail. The flow of wheel axle shunt current is indicated by arrows 18. The portion of this shunt current is divided into components $I_R$ and $I_A$ seen in FIG. 1. These components are, respectively, the vertical component flowing through the radius of the wheel 10 and the component in the horizontal direction through the axle 12. Of course, these components are identical in value, but their particular orientation and the flux resulting therefrom is important with respect to certain embodiments to be described.

Referring now particularly to FIG. 2, there will be seen a fragmentary schematic of the complete detection system. This system is a vital system as defined previously; however, it is in most respects identical to the system illustrated in FIG. 3 of U.S. Pat. No. 4,351,504, the disclosure of which is incorporated here by reference. Included here is a detection zone 20 defined by a west boundary shunt means in the form of a shunt strap 22, and an identical east boundary shunt means in the form of another shunt strap 22. The detection zone 20 is further defined by those portions of the north and south rails 14 bounded by the shunt straps 22, thereby forming a first or detection loop 24. A signal source, not illustrated, is connected at its one end to the detection loop 24, and at its other end to a feed loop 26. The opposite end of such feed loop 26 is seen connected by a suitable connection 28 to the detection loop 24.

It will be appreciated that the current flow subdivides into substantially equal portions in each of the loops 24 and 26, as will be understood by reference to the current arrows 29. The center line of detection zone 20 is designated 30, the connection 28 being on the center line. The pick-up coil 16, already seen in FIG. 1, is located to the right of center line 30 in FIG. 2 and is closely adjacent to the south rail 14. It will be understood that because the respective loops 24 and 26 have current flow therein which is divided into two halves, there is a complete cancellation due to opposing fields and hence there is no net field, when there are no wheel axles present in the detection zone. In any case, the orientation of the pick-up coil 16 is such that it, per se, is normally not sensitive to fields produced by currents in either the inner or feed loop 26 or in the outer or rail loop 24. There is, however, an output signal from the pick-up coil 16 responsive to the wheel-axle shunt current because the fields produced by such current link with the pick-up coil.

The significantly different feature of the present invention, when compared with that of U.S. Pat. No. 4,351,504, resides in the fact that the sensing means 40, which includes or incorporates the pick-up coil 16 already referred to, also includes a biasing means, here in the form of an independent bias coil 42, which is connected by way of a resistor 44 to a winding 46 linked in an appropriate sense to the pick-up coil 16. This sense is such as to oppose the dynamic signal induced in pick-up coil 16 when a wheel axle is present adjacent such coil. Accordingly, in the normal state, that is when there are no wheel-axles present, a steady state, bias current will be generated or induced in pick-up coil 16. Similarly, a second sensing means 50 can also be provided so as to include another pick-up coil 52 which is identical to pick-up coil 16 except that it is located to the left of centerline 30. Similar components, comprising a bias coil 54, resistor 56 and winding 58, are shown for sensing means 50.

The operation of the complete system can be thoroughly appreciated by the graphical presentation in FIG. 3. The coupling of windings 46 and 58 to their respective coils 16 and 52 results in providing an output which effectively has a value indicated by the fixed value portions of the curves 60 and 62. The curve 60 is shown in solid lines and represents the output from pick-up coil 16, while the dotted line showing is for the pick-up coil 52. The dips in the respective curves occur as a given wheel-axle passes in close proximity to the respective pick-up coils. It will be appreciated that wheel-axle shunt current 18 is the cause of the aforenoted dips in the response curves, since only this current direction produces abrupt flux changes which link with the pick-up coils 16 and 52.

Fail-safe operation is provided by the scheme set forth in FIG. 2 because, if the source signal stops because of an open circuit condition, the output signal goes to zero.

Referring now to FIG. 4, there is illustrated a slightly different arrangement from the scheme or embodiment of FIG. 2. In this arrangement, the bias signal is obtained in a different way in order to provide the vital wheel detector, or inverted signal, feature. Instead of an additional coil, that is, a bias coil, such as the coil 42 of FIG. 2, a direct connection is made to the feed loop and the rail loop at points A and B, respectively, in order to establish the requisite bias current.

Referring now to FIG. 5, there is illustrated a further, or second, embodiment of a vital directional wheel detector. Instead of utilizing series-connected, inner and outer loops within the detection zone, the track is fed directly rail-to-rail by a feed wire 60 from a relatively constant voltage source 62. However, as was the case with the first embodiment, the path for current flow involves subdivision into several loops as indicated by the arrows denoting current flow, such arrows being designated 64. Shunting means in the form of shunt straps 66 are again used to define the detection zone.

The current path through the rails and shunt straps is made to have a lower impedance than the lowest wheel-axle impedance. Moreover, in the scheme or embodiment of FIG. 5, the system is self-biasing. Thus, instead of providing separate bias coils for developing the bias current, the system of FIG. 5 relies on the individual pick-up coils illustrated—that is, pick-up coil No. 1 and pick-up coil No. 2—for this particular purpose, as well as for the same purposes essentially as before. Accordingly, in addition to being responsive to the abrupt signal changes resulting from the passage of a wheel-axle set in the detection zone, the pick-up coil No. 2, for example, is oriented in such a manner that it is directly sensitive to current flow 64 in the rail, such current flow affecting the pick-up coil 2, as indicated by the flux 68 to develop the necessary bias signal. However, in this particular scheme or embodiment, the pick-up coil No. 2 is selectively sensitive to a particular component of current flow; that is, to the current component in a vertical direction flowing up the radius of the wheel-axle set, such current component being designated 70, creating flux 86 in FIG. 5. On the other hand, the pick-up coil No. 2 is insensitive to the current flow in the feed wire 60, as well as in the shunt straps 66; furthermore, it is insensitive to the current in the axle portion, that is, the horizontal component of current 72 in the axle 74.

It will be appreciated that the pick-up coil No. 2 (and, for that matter, the "mirror image" pick-up coil No. 1, illustrated in dotted lines) can be located anywhere on a 45° angle plane, bisecting the angle between the rail and the vertical wheel radius when the pick-up coil is located near to the center of the detection zone. For proper clearance purposes, however, the pick-up coil is located on this plane outside of the rail. Of course, the further the pick-up coil is outside the rail, the lower its output will be.

Figure 6:
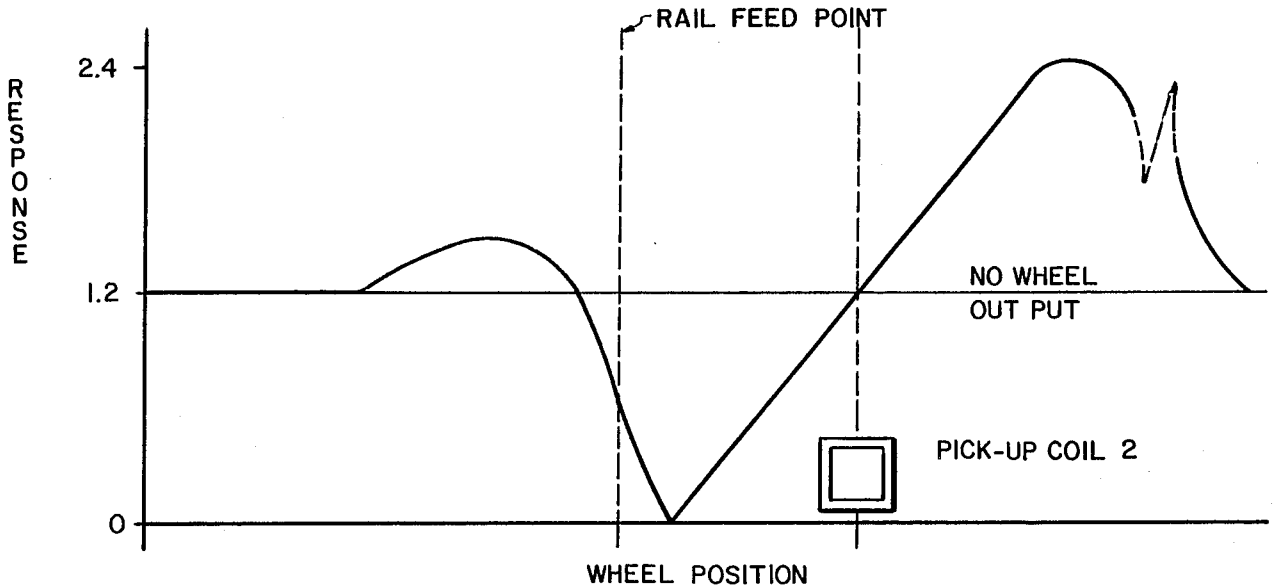
FIG. 6 is a graph of response versus wheel position for the detector embodiment of FIG. 5.

In the operation of the system of FIG. 5, it will be apparent that when there are no wheels in the detection zone, designated 80 (defined by the shunt straps 66 and by the portions of the rails 82 which are bound thereby), the pick-up coil No. 2 has a relatively high output signal (FIG. 6), due to the current 64 in the rail which flows toward the shunt straps 66. When the wheels 84 are located between the shunt strap 66, at the right, and the pick-up coil position, the coil output increases because the flux 86, resulting from the current 70 through the wheel radius of the near wheel, is added to the flux 86 derived from the rail current 64. When the wheel is in-line with the pick-up coil, coil output is back to the "no wheel" value, because the coil is at a "flux null" produced by the current flowing through the wheel radius. When the wheel is between the pick-up coil 2 and the rail feed point, the pickup coil output drops, because the sense of the flux 86 produced by the current flowing through the wheel-axle is then in opposition to the flux produced by the rail current 64. Since the rail current is always greater than the axle current, the axle current flux can never "over-cancel" the rail current flux.

Since in the scheme depicted at FIG. 5, the bias to invert the wheel detection pulse is generated by the feed current through the rail, this itself is considered to provide "fail-safeness". In other words, there is one less thing to go wrong inasmuch as there is not a separate or independent bias coil with a separate bias circuit. Also, of course, if the feed circuit develops an open circuit, or the pick-up coil develops an open circuit, or the pick-up coil gets knocked out of place, the output signal will drop, thereby indicating a wheel presence—which is the most restrictive output.

Three additional embodiments that were developed in accordance with the present invention will now be described; these particular embodiments were actually set up and evaluated on a test track.

Referring to FIG. 7, such a test track is seen consisting of two eight-foot sections of rails 14. A wheel-axle set is simulated by a shunt strap 100 of U-shaped construction to correspond with the radius portion of the wheels and with the axle portion of a single wheel set. To permit the movement of the wheel shunt 100 through the detection zone, heavy duty, magnetic welding ground contacts 102 are used at the ends of the shunt strap, the strap being supported by bars 104. To provide different shunt impedance values, hereinafter designated A and B, either a number 6 shunt alone (0.56 ohms) is connected as part of the strap 100, or alternatively, a resistor $R_{SH}$ having a value of 0.5 ohms is connected in series with the number 6 shunt, thereby to give a total value of 0.82 ohms.

Referring now to FIGS. 8A–8D, there is seen a third embodiment of the vital wheel detector system. This embodiment provides immunity against rail-carried traction noise. The "figure eight" sense coil 110 cancels out the pick-up of foreign current flowing through the rail; however, it will sense the feed current which splits and flows in opposite directions in the near rail 14 from the feed connection. Theoretically, the sense coil 110 has maximum coupling to the rail feed current when it is horizontal, and minimum coupling when vertical. Likewise, the sense coil has maximum coupling to the shunting current flowing through the wheel-axle when it is vertical and minimum coupling when it is horizontal. Since it is necessary to balance the "bias" rail current pick-up against the wheel shunt current pick-up, the proper balance adjustment can be achieved by adjusting the sense coil's angle in a horizontal plane.

Figure 8A:
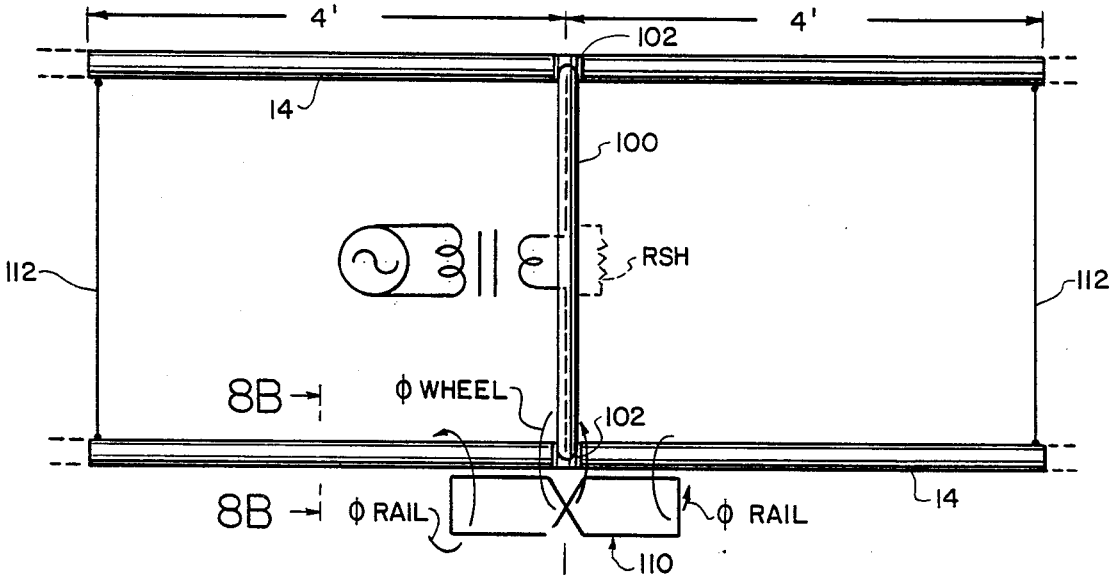
FIGS. 8A–8D illustrate a further or third embodiment of the vital wheel detector system.
Figure 8B:
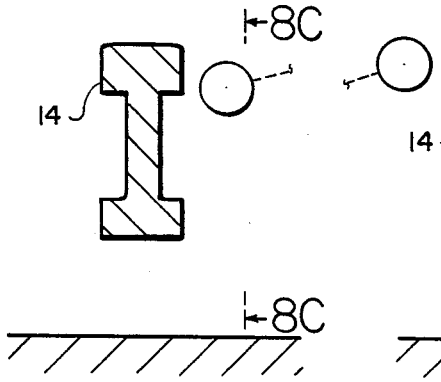
Figure 8C:
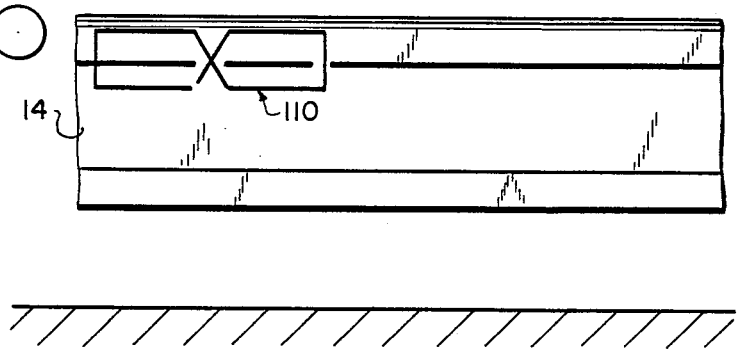

It will be noted that the sense coil 110 is outside of the rail and below the top of the rail, as particularly seen in FIG. 8A–8C. Accordingly, it is relatively easy to protect. It will also be appreciated that directional detection can be achieved by mounting a sense coil similar to sense coil 110 but adjacent the opposite rail 14; or alternatively, by assembling two sense coils 110 in the same rail mounting unit, with one staggered a few inches from the other.

Figure 8D:
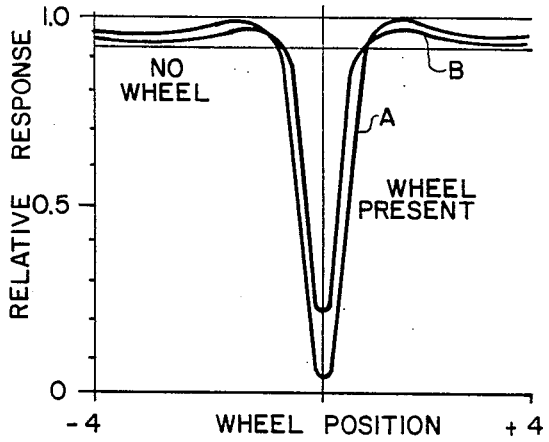

As will be seen from FIG. 8D, a sharp response is attained with this particular configuration and, even with a relatively poor shunt, which is the case illustrated by the curve B, a good signal ratio is achieved between the "wheel present", or detection, signal and the "no wheel" signal.

It should be noted that, in most cases, the tests were made with a 30 KHz signal; however, this frequency is not critical and could typically range between 20 to 50 KHz. As with all the configurations that will be discussed herein, the boundary shunts, such as shunts 112 in FIG. 8A, are zero gauge wire and are used to maintain a relatively stable bias signal; also, they function to minimize the effects of adjacent wheels, and to minimize the effects of ballast resistance changes. The effects of adjacent wheels and ballast resistance changes have less than a ten percent effect on the output of the sense coil during the detection of a wheel-axle.

Another, or fourth embodiment, of the vital wheel detector of the present invention, is illustrated in FIGS. 9A–9D. This embodiment is a modification of the original non-vital track circuit wheel detector, as previously disclosed in the aforenoted U.S. Pat. No. 4,351,504 to the same assignee. The modification is such as to make the wheel detector a vital wheel detector. For this purpose, a separate "feed sense" coil 120 has been added to provide the "bias" signal. This feed sense coil is set-up so that it is only sensitive to the feed current fed from the signal source 122. As before, the current from source 122 is fed to two series-connected feed loops, designated detection loop 124 and feed loop 126, the detection loop 124 including the rails 14. The main pick-up coil 130 is disposed in the same manner as in U.S. Pat. No. 4,351,504; that is to say, it has its midpoint on the center line of the detection zone 140. This pick-up coil is referred to as the "wheel sense" coil and it is oriented so that it can only sense the shunting current flowing through the wheel and axle, whereby this embodiment is immune to traction noise currents flowing in the rails.

The feed sense coil 120 and the wheel sense coil 130 are connected in series opposition, so that the output of the wheel sense coil, when a wheel is present, opposes the output of the feed sense coil.

Figure 9A:
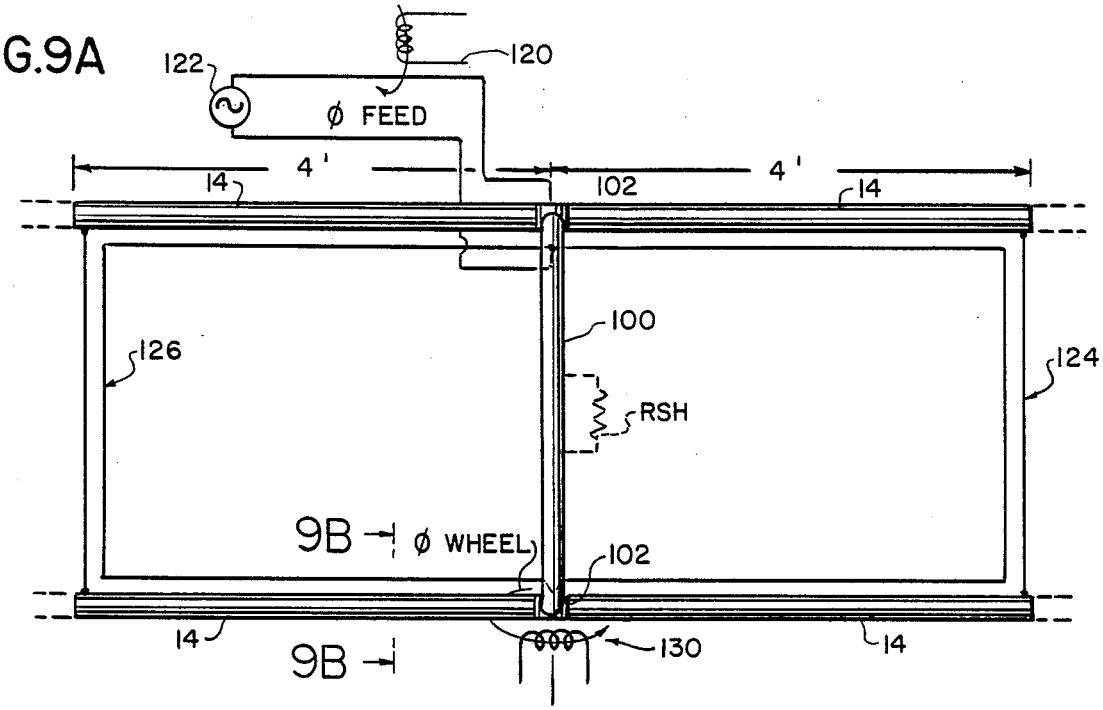
FIGS. 9A–9D illustrate another, or fourth, embodiment of a vital wheel detector.
Figure 9B:
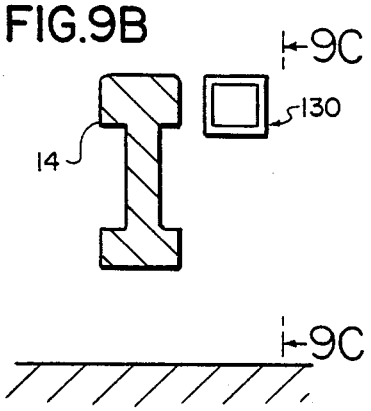
Figure 9C:
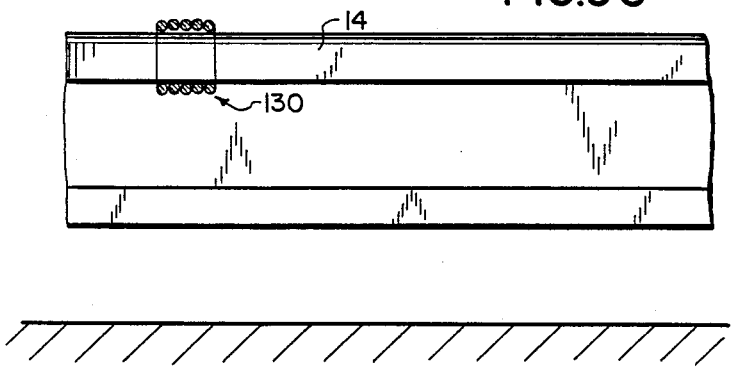
Figure 9D:
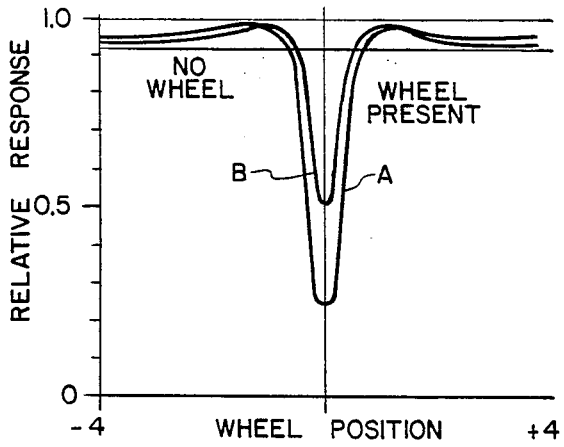

As will be seen from FIG. 9D, reasonably good detection responses were obtained for both the A and B conditions (where A is shorted No. 6 shunt, as previously, having an impedance of 0.56 ohms; and B is a No. 6 shunt with $R_{SH}$ in series, for a resultant impedance of 0.82 ohms).

It will be understood that the same kind of shunting means 100, as shown in FIG. 7, is used in this embodiment to simulate the presence of a wheel-axle; and that the shunting means or device is moved through the detection zone in order to obtain the response curves of FIG. 9D. It will be appreciated that the embodiment of FIGS. 9A–9D has a more complicated rail feed arrangement than other embodiments, in view of the series-connected loops 124 and 126 which operate to cancel out all rail feed fields.

Yet another embodiment, a fifth embodiment, is seen in FIGS. 10A through 10D. This embodiment is directed to eliminating the requirement for the extra, feed sense coil previously seen in FIGS. 9A through 9C. In most other respects, it is similar to the previous or fourth embodiment inasmuch as it utilizes a pick-up coil 130 whose mid-point is positioned on the centerline of the detection zone. However, instead of the feed arrangement characteristic of that fourth embodiment, which involves both a feed loop and a detection loop, this embodiment relies on a feed line 132 connected across the rails 14.

Figure 10A:
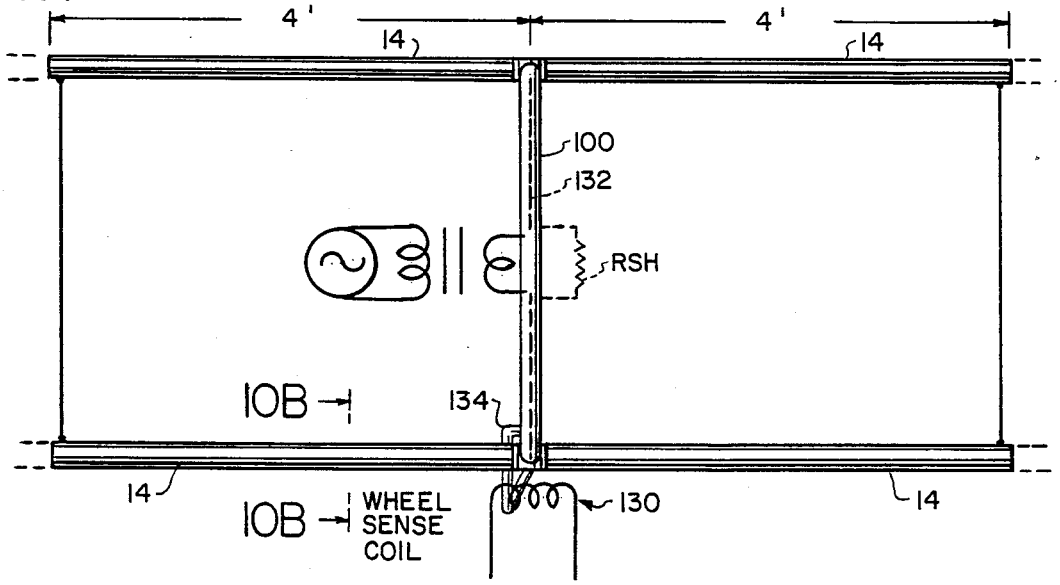
FIGS. 10A–10D illustrate a fifth embodiment of the vital wheel detector.
Figure 10B:
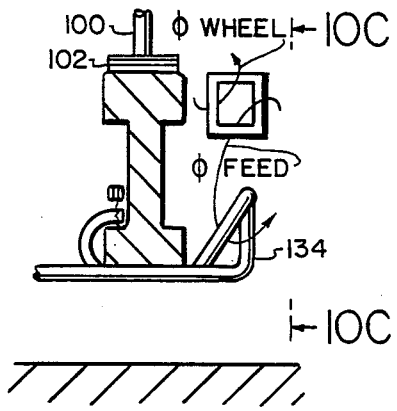
Figure 10C:
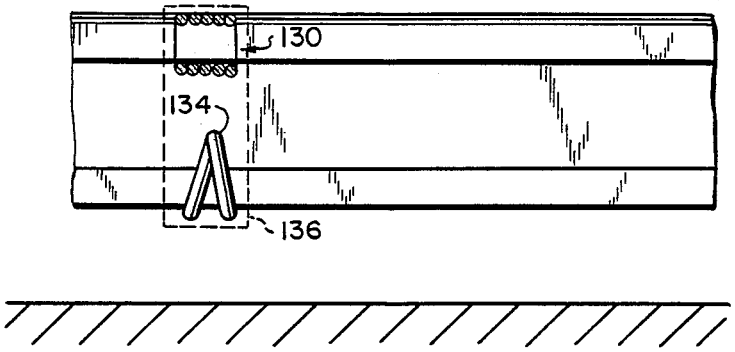
Figure 10D:
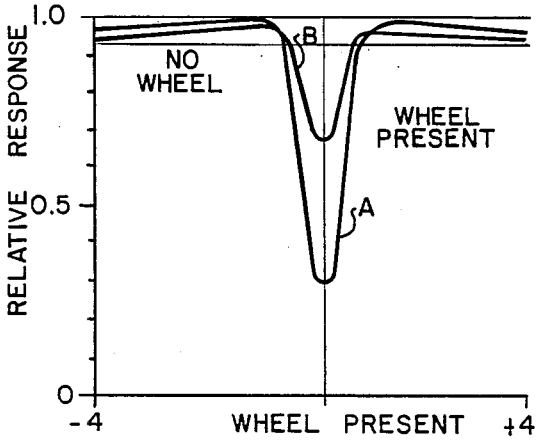

In place of the feed sense coil, which is omitted here, the feed conductor 134 which is connected to the near rail 14, is brought adjacent to the pick-up coil 130 (see FIGS. 10B and 10C). Hence, this pick-up coil 130 is affected not only by the flux, $\phi$ wheel, due to the current flowing in the shunt 100 simulating a wheel-axle, but is also affected by the flux from feed current flowing in conductor 134.

In order to insure that the flux from the conductor 134 is always linked with the pick-up coil 130, thereby to make certain that operation will be fail-safe, the end of the conductor 134 can be supported or mounted as a single unit with coil 130 in an assembly 136. In this manner, the feed flux, $\phi$ feed, will always be linked with the pick-up coil 130.

It will be apparent to those skilled in the art that if direction sensing is to be included, in a manner similar to the first two embodiments earlier discussed, then an additional wheel sense coil, identical to coil 130, can be included in the coil mounting assembly 136.

There has been disclosed in the present specification a variety of embodiments for a vital track circuit wheel detecting system. The unifying concept common to all these embodiments is the concept of achieving a vital operation by inverting the output signal sense and insuring that failure modes will cause the output to indicate a continuous wheel occupancy. The fundamental notion then is to generate a "bias" signal which is provided as the output indication when no wheels are present in the detection zone. The "wheel present" signal subtracts from this "bias" level, thereby producing a signal dip for each wheel-axle detected. In order to make this approach fail-safe, it is necessary to make the "bias" signal dependenton the signal-feed source so that a failure in the feed circuit disables the bias signal. Moreover, it is a requirement that any failure which disables that portion of the output which is due only to the wheel-axle shunting effect, also reduces or disables the detection output of the detector system. In general, configurations which utilize a single pick-up coil that senses both the bias signal and the wheel-axle shunting signal meet this requirement.

It will be understood by those skilled in the art of wheel detection schemes that, since the sense coil is sensitive to flux levels, the wheel detectors of the present invention are true "presence" detectors, being able to detect wheels moving through a detection zone down to zero speed.

While there have been shown and described what are considered at present to be the preferred embodiments of the present invention, it will be appreciated by those skilled in the art that modifications of such embodiments may be made. It is therefore desired that the invention not be limited to these embodiments, and it is intended to cover in the appended claims all such modifications as fall within the true spirit and scope of the invention.

I claim:

1. A vital, or fail-safe, track circuit wheel detector system for detecting the presence and position of wheel-axles on railroad cars, comprising:

a pair of rails;

a pair of boundary shunt means spaced independently of minimal wheel spacing;

a path for current flow, said path including said rails and said pair of boundary shunt means so as to define a detection zone;

a transmitter or source having a high frequency output;

means for coupling said transmitter to said path;

sensing means, including a pick-up coil, for providing a steady, bias output signal, derived from said path for current flow, responsive to the absence of wheel-axles in said detection zone;

said pick-up coil being oriented outside of the rails and adjacent to the center line of said detection zone, for sensing field changes due to particular directional components of wheel-axle shunt current flow when a wheel-axle is in close proximity to said pick-up coil;

said directional components being such as to oppose said steady, bias output signal, thereby providing a net reduced signal at the output of said pick-up coil to indicate the presence of said wheel-axle.

2. A system as defined in claim 1 in which a bias coil is coupled to said path for current flow, said bias coil being adjacent one of said rails for deriving a bias signal from said path for current flow.

3. A system as defined in claim 2, further comprising a bias winding and a resistor connected to said bias coil, thereby defining a bias circuit coupled to said pick-up coil.

4. A system as defined in claim 3, in which an additional bias circuit is included and an additional pick-up coil, thereby to provide directional indications.

5. A system as defined in claim 4, in which said bias circuit and pick-up coil arrangements are disposed on opposite sides of a centerline through said detection zone.

6. A system as defined in claim 4, in which said bias circuits are connected directly to one of the rails of said system.

7. A system as defined in claim 1, in which said pick-up coil is so oriented as to be directly responsive both to flux from one of said rails and from directional components of wheel-axle shunt current.

8. A system as defined in claim 1 in which said sensing means includes a figure-8 pick-up coil whose midpoint is on the centerline of said detection zone.

9. A system as defined in claim 1, in which said source is coupled to said path for current flow by a feed wire connected across said rails.

10. A system as defined in claim 1, in which a single coil defining a solenoid serves as the pick-up coil and has its midpoint located on the centerline of said system.

11. A system as defined in claim 10, further comprising first and second series connected loops, each of said loops being subdivided for current flow into two substantially equal portions with respect to the centerline of said detection zone.

12. A system as defined in claim 11, in which an additional feed coil is coupled to the source or transmitter for providing a bias signal.

13. A system as defined in claim 12, in which said feed coil is closely spaced from said pick-up coil so as to couple feed current flux to said pick-up coil.

14. A system as defined in claim 12, in which said pick-up coil and said feed coil are both encapsulated in a single unit or assembly.

* * * * *